United States Patent [19]

Neff

[11] Patent Number: 5,060,736

[45] Date of Patent: Oct. 29, 1991

[54] STEERABLE TOOL UNDERREAMING SYSTEM

[75] Inventor: Michael C. Neff, Cults-Aberdeen, Scotland

[73] Assignee: Smith International, Inc., Houston, Tex.

[21] Appl. No.: 570,059

[22] Filed: Aug. 20, 1990

[51] Int. Cl.[5] ..... E21B 7/08

[52] U.S. Cl. ..... 175/74; 175/76; 175/267

[58] Field of Search ..... 175/61, 73, 74, 75, 175/76, 267

[56] References Cited

U.S. PATENT DOCUMENTS

| | | | |
|---|---|---|---|
| 4,465,147 | 8/1984 | Feenstra et al. | 175/73 |
| 4,660,657 | 4/1987 | Furse et al. | 175/269 |
| 4,667,751 | 5/1987 | Geczy et al. | 175/61 |
| 4,697,651 | 10/1987 | Dellinger | 175/61 |
| 4,817,740 | 4/1989 | Beimgraben | 175/74 |
| 4,877,092 | 10/1989 | Helm et al. | 175/74 |
| 4,886,130 | 12/1989 | Evans | 175/73 |
| 4,932,482 | 6/1990 | DeLucia | 175/75 |

OTHER PUBLICATIONS

SPE Paper No. 13026, "PDM Versus Turbo-Drill: A Drilling Comparison," 1984.

*Primary Examiner*—William P. Neuder
*Attorney, Agent, or Firm*—Robert M. Vargo

[57] ABSTRACT

A bottom hole assembly is described having a bit driven by a downhole motor and stabilizers located above the motor on the drill string. A subassembly is also provided for controlling the bit trajectory that is operational on demand at the rig site. The subassembly comprises an underreamer located directly above the bit. The underreamer is hydraulically actuated to retract and extend the cutters.

5 Claims, 2 Drawing Sheets

STEERABLE TOOL UNDERREAMING SYSTEM

BACKGROUND OF THE INVENTION

I. Field of the Invention

The present invention relates generally to steerable drilling systems and more particularly to steerable drilling systems having on-demand directional control subassemblies for controlling bit trajectories in response to changing downhole conditions.

II. Description of the Prior Art

A steerable drilling system conventionally comprises a bit, a downhole motor, measurement while drilling components and stabilization. The system is designed to control bit trajectory without the need for tripping in both directional and straight hole applications. Steerable systems should provide the ability to: build, turn, hold or drop angle in a predictable manner; drill a smooth well path, minimizing dogleg severity; monitor wellpath with continuous directional surveys; allow surface control of bit trajectory in response to changing downhole conditions; optimize drilling parameters for fastest rate of penetration; and remain downhole drilling, requiring trips only to change bits or set casing.

To enable steering of the bit, steerable systems are designed for two modes: orienting and rotating. In the orienting mode, the drillstring is not rotated while the bit is turned by the downhole motor. The assembly is designed to impart a side load on the bit through either offset stabilizers or bends in the assembly. Sideloading causes the bit to deviate the wellpath. In the rotary mode, the drillstring is rotated in addition to bit rotation by the motor. The intentional bit sideloading rotates with the drillstring, thus negating its deviating effect.

There are three general categories of commercially available steerable systems: those systems which use eccentric stabilizers with downhole motors, described in U.S. Pat. No. 4,465,147; those systems which use adjustable bent subs above the motors; and motor housings with one or two bends, described in U.S. Pat. Nos. 4,667,751 and 4,932,482.

An offset stabilizer on the motor can be used on turbine or positive displacement motors, the greater the offset, the larger the rate of hole curvature. However, the amount of offset allowable is limited, which in turn limits the achievable hole curvatures (system response). This system type is sensitive to hole enlargement which acts to reduce the stabilizing effect.

A downhole-adjustable bent sub above the motor can be used as a steerable system. In the orienting mode, the system is essentially the same as a conventional directional drilling bottom hole assembly except for the ability to alter the bend angle downhole. Bend angles in the range of 1 to 3 degrees are required, which generate large bit offset and increased sensitivity to drilling parameters. Stabilization on the motor severely limits hole curvature in the orienting mode. In the rotary mode, the bend angle can be adjusted to zero, eliminating intentional bit sideloading. The system tends to drop angle without near bit stabilization in the rotary mode.

The majority of steerable system runs are with bend housing positive displacement motors (1 or 2 bends) and stabilization on the motor.

Heretofore, none of the above-mentioned steerable systems had the ability to correctly control bit trajectory in response to changing downhole conditions.

SUMMAY OF THE INVENTION

The present invention obviates the shortcoming discussed above by providing a subassembly for controlling the bit trajectory that is operational on demand at the rig site.

The steerable system comprises a bottom hole assembly having a bit being driven by a downhole motor, the motor preferably have a bent housing formed thereon. Stabilization is also provided directly above the motor and further up the drill string. The bit is directly connected to an underreamer having a set of cutters rotatably mounted on retractable arms. The underreamer is hydraulically actuated to retract and extend the cutter arms, to allow the cutters to expand into the formation.

Therefore, proper utilization of the underreamer will cause the underreamer to alter the trajectory of the bit during operation.

One embodiment of the bottom hole assembly could also use an expandable stabilizer directly above the motor. Such a stabilizer would also be hydraulically actuated in the same manner as the underreamer.

The above noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
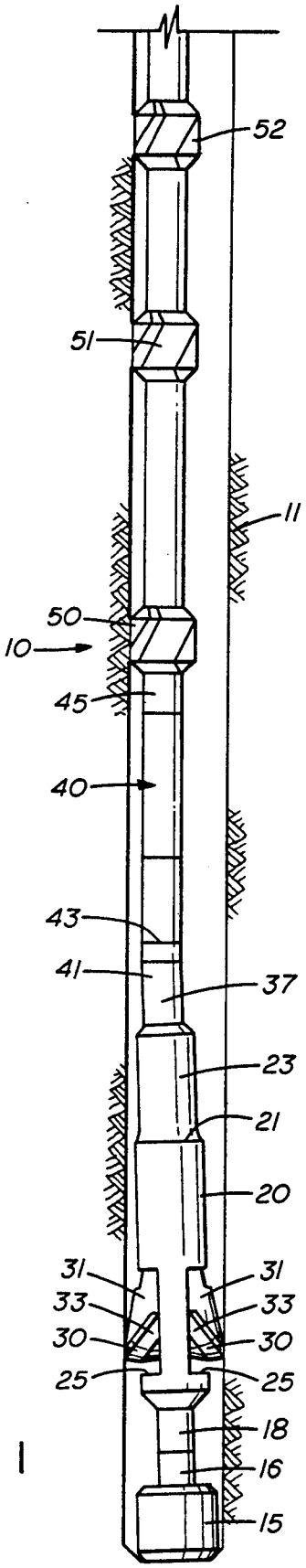
FIG. 1 is a diagrammatic illustration of the basic components of the bottom hole assembly of the present invention.

Referring now to FIG. 1, the basic components of the bottom hole assembly 10 of the present invention are illustrated. The borehole 11 is shown in an oversized and exaggerated manner.

The first element of the bottom hole assembly 10 of the present invention is a drill bit 15. The drill bit 15 is shown schematically and can be either a rolling cone rock bit, a diamond bit or a PDC (polycrystalline diamond compact) bit.

The upper end 16 of the drill bit 15 includes a threaded pin section (not shown) which is adapt to threadedly engage a box section (not shown) of the lower end 18 of an underreamer 20.

The underreamer 20 is conventional in structure and is similar to that described in U.S. Pat. No. 4,660,657, incorporated by reference herein.

The underreamer 20 includes a main body 21 having an upper reduced fishing neck 23. The lower end of the underreamer 20 includes a pair of openings 25 for receiving a pair of retractable end extendable cutters 30. Each cutter 30 comprises a movable arm 31 pivotally mounted within the main body 21. Each arm 31 has a rolling cone cutter 33 rotatably mounted thereon. The movement of the arms 31 are controlled and operated by hydraulically actuated cam means which will be more thoroughly described in connection with FIGS. 3 and 4.

The upper end 35 of the fishing neck 23 includes a pin connection (not shown) which is connected to the lower end of an output shaft 37 of a downhole motor 40. The downhole motor 40 utilized with this type of arrangement is preferably a positive displacement motor of the type described in SPE paper No. 13026 entitled "PDM Versus Turbo-Drill: A drilling comparison".

The output shaft 37 of the motor 40 is concentrically located within a bearing assembly 41. This shaft is in turn connected through a bent housing 43 to the output shaft of the downhole motor 40. The housing of the downhole motor 40 is in turn connected to the drill string casing 45 which extends all the way to the surface of the borehole 13 and is in turn connected to the means for rotating the entire assembly from the surface i.e. the rotary table (not shown).

The bottom hole assembly also includes a plurality of concentric stabilizers 50, 51, and 52 precisely located along the drill string with respect to the drill bit 15 and with respect to each other.

Figure 2:
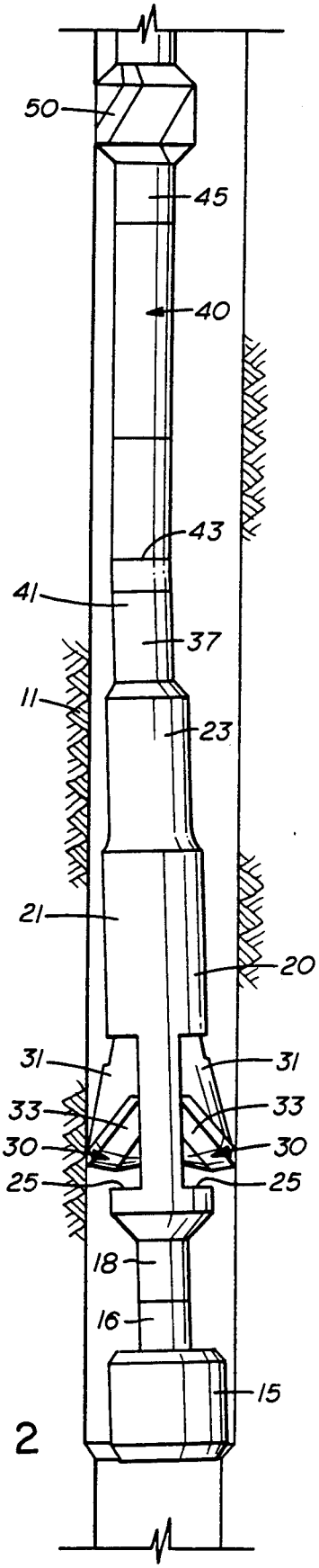
FIG. 2 is a diagrammatic illustration of the lower end of the bottom hole assembly showing how the bit offset is obtained.

An important thing to remember with respect to the illustration of FIG. 1 is that the centerline of the bit 15 is offset from the centerline of the borehole 11 in an amount determined by the offset (FIG. 2) which is fixed by the bent housing 43 that is connected between the downhole motor 40 and the motor bearing assembly 41. The utilization of the bent housing 43 at this precise point in conjunction with the concentric stabilizers as shown in FIG. 1 has proven to be a major factor in increasing the rate of penetration of this particular bottom hole assembly beyond that heretofore available.

Figure 3:
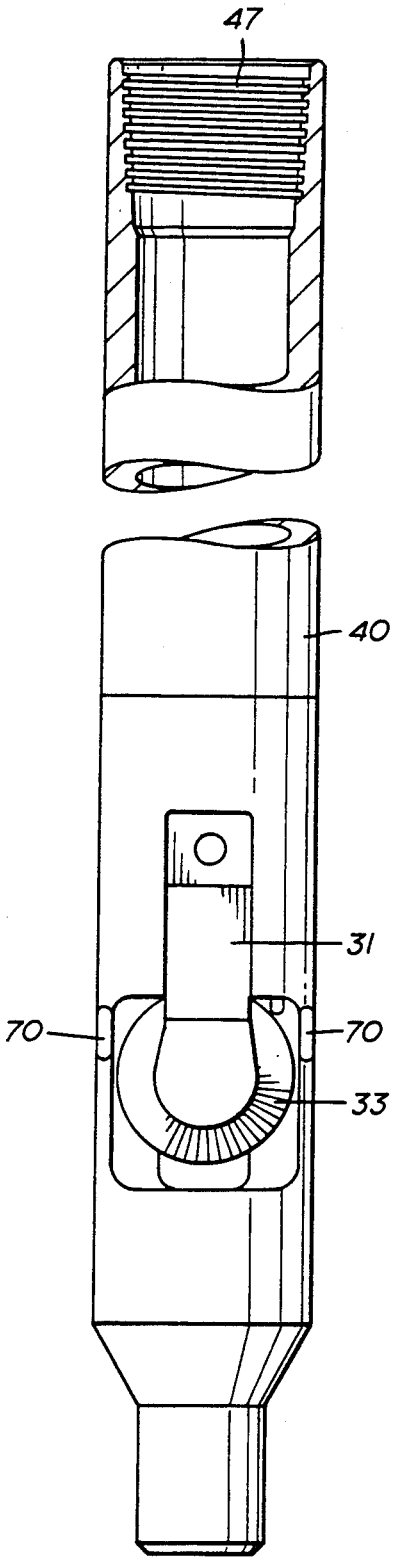
FIG. 3 is an enlarged side view of the underreamer utilized in the present invention.
Figure 4:
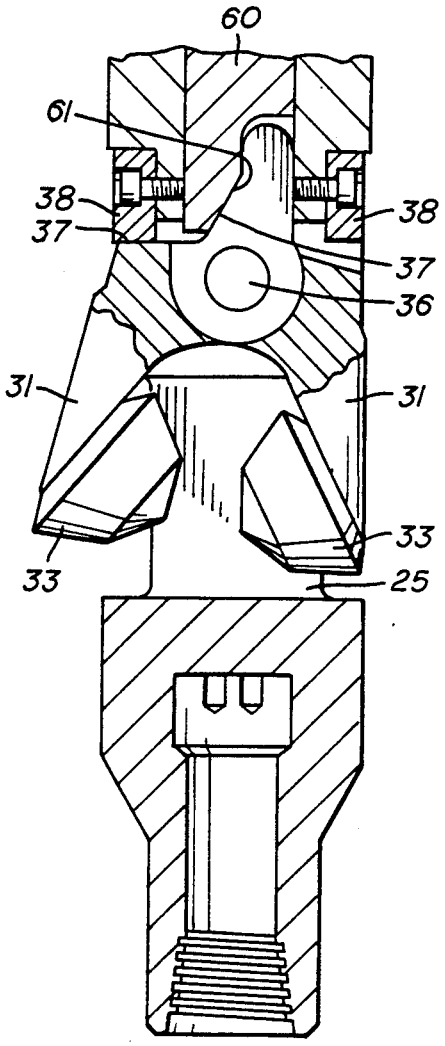
FIG. 4 is a sectional view of the underreamer showing the cutters in an extended and retracted position.

Referring now to FIGS. 3 and 4, the upper portion of the main body section 40 forms a threaded box connection 47 which is adapt to be connected to a pin connection located at the lower end of the fishing neck portion 23 of the underreamer 40.

The pair of pivotable arms 31 are mounted in the lower body for pivoting between a retracted position and an extended underreaming position. The generally conical cutters 33 are mounted on the cutter arms 31. These cutters are indicated schematically in the drawings and it will be understood that they can have milled teeth, cemented tungsten carbide inserts or the like for cutting rock formation in a conventional manner.

In the longitudinal cross section of FIG. 4, the right hand arm 31 is illustrated in its retracted position with its cutter 33 in an open pocket 25 in the lower bcdy. The left arm 31 is illustrated in its extended position with its cutter 33 protruding laterally from the lower body for reaming surrounding rock formation.

The cutter arms 31 are mounted on the lower body by a cylindrical hinge pin 36. Each cutter arm 31 has a lower portion on which the cutter 33 is mounted and an upper follower portion 37 which is one-half the width of the lower portion. The two arms 31 are mounted on the hinge pin 36 is a scissors fashion. The half width portions of the cutter arms 37 are on opposite sides of the center line of the underreamer and can swing past each other so that the two arms swing in opposite direction.

A pair of rectangular arm stop plugs 38 are bolted to the lower body above the pocket 25 in which the arms 31 are fitted. The stop luqs limit the pivoting of the arms toward the extended position thereby determining the diameter of the hole that is reamed. They also transmit load from the body 40 to the arms 31 when reaming. Different arm configurations can be used for obtaining a desired reaming diameter.

The arms 31 are actuated by an axially extending plunger 60. The upper end of the plunger is threaded into a piston (not shown). The plunger 60 is also maintained in a fixed rotational orientation of the lower body. At the lower end of the camming plunger 60 there are a pair of opposite diagonal cam faces 61. only one of which can be seen in the illustration of FIG. 4. The hidden cam face is the same as the one illustrated and faces in the opposite direction. Each cam face engages the half width follower portion 37 of one of the arms When the camming plunger 60 is in its upper position the cam faces are clear of the upper ends of the arms and the arms are free to pivot toward their retracted position. When the camming plunger moves downwardly the cam faces engage the curved faces of the upper follower portion 60 on the arms, thereby spreading them apart and camming the arms in opposite directions toward their extended underreaming position.

The hydraulic and spring actuation of the camming plunger is described in detail in U.S. Pat. No. 4,660,657 and is incorporated by reference herein.

A plurality of openings and passages (not shown) are provided through the main body to enable drilling fluid to flow therethrough.

Four passages also terminate in nozzle orifices 70 adjacent the cutters to direct drilling mud into the space around the lower body adjacent to the cutters in their extended position and into the lower body for keeping the pocket clear of chips or the like that might inhibit retraction of the cutters.

When the underreamer is used, drilling fluid is pumped down the inside of the drill string that supports the underreamer, and returns uphole in the annulus between the drill string and the wellbore. The hydraulic pressure differential results in application of hydraulic force tending to shift the piston towards its lower extended position against the force of the spring.

To retract the cutter arms, the circulation of the drilling mud is discontinued and the underreamer is lifted slightly, allowing the cutter arms to pivot back into the pocket.

The bottom hole assembly of the present invention stabilizers located at specific distances and having a differential undersize, and a specific offset angle to accomplish the kickoff. For straight hole drilling both the downhole motor-underreamer bit assembly and the drill string are rotated together. Rotation of the drillstring nullifies the directional characteristic built into the downhole assembly.

When kickoff is required, only the downhole motor-underreamer-bit assembly is rotated causing the assembly to take on its full directional characteristic, kick off and follow the well plan. Once complete kickoff is established, the drillstring can again be rotated if the downhole assembly starts to build too great an angle. In this way the downhole assembly is steered to its target.

Figure 5:
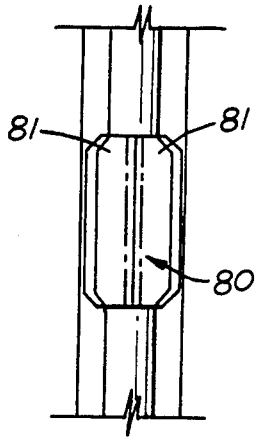
FIG. 5 is an enlarged side view of an adjustable gauge stabilizer utilized in a second embodiment of the present invention.

Many modifications and variations of this invention will be apparant to those skilled in the art. For example, various bits can be utilized in addition to various offset angles of the bent housing. A bent sub can also be utilized above the motor. The motor-underreamer-bit assembly can be used by itself, with the underreamer utilized as the near bit stabilizer, or the assembly can also be used with one, two, or more concentric or eccentric stabilizers up the drill string. In addition, FIG. 5 illustrates an expandable blade stabilizer 80, the component itself being well known in the art. Such a stabilizer is mechanically activated to adjust the gauge and move the stabilizer blades 81 inwardly and outwardly to help control the inclination of the directionally drilled well.

What is claimed is:

1. A steerable bottom-hole assembly comprising a downhole motor of the tubular type, said motor having a bent housing, an underreamer rotatively interconnected to the lower end of the motor and a drill bit interconnected to the lower end of the underreamer, said underreamer functioning as the first point of stabilization to control the trajectory of the bottomhole assembly and enlarge the bore hole.

2. The invention of claim 1 wherein the underreamer comprises a tubular main body having a pair of arms pivotally mounted thereon, and a cutter rotatively mounted on each arm.

3. A steerable bottom-hole assembly comprising a downhole motor of the tubular type, said motor having a bent housing, an underreamer rotatively interconnected to the lower end of the motor, a drill bit interconnected to the lower end of the underreamer, said underreamer functioning as the first point of stabilization to control the trajectory of the bottomhole assembly adn enlarge the bore hole, and a stabilizer interconnected to the upper end of the motor, siad stabilizer functioning as the second point of stabilization to control the trajectory of the bottomhole assembly.

4. The invention of claim 3 wherein the stabilizer comprises a tubular main body having a plurality of blades mounted thereon and extending radially outwardly therefrom.

5. The invention of claim 4 wherein the stabilizer blades are movable with respect to the main body to move radially inwardly and outwardly upon command.

* * * * *